US005967910A

United States Patent [19]

Lin

[11] Patent Number: 5,967,910

[45] Date of Patent: Oct. 19, 1999

[54] BASEBALL HITTING EXERCISER

[76] Inventor: Mike Lin, No. 32, Lane 395, shui yuan Rd., feng yuan county, Taiwan

[21] Appl. No.: 08/929,682

[22] Filed: Sep. 15, 1997

[51] Int. Cl.[6] ..... A63B 69/00

[52] U.S. Cl. ..... 473/417

[58] Field of Search ..... 473/417, 418, 473/419, 420

[56] References Cited

U.S. PATENT DOCUMENTS

| | | | |
|---|---|---|---|
| 4,445,685 | 5/1984 | Cardieri | 473/417 |
| 4,796,885 | 1/1989 | Wright | 473/417 |
| 4,819,937 | 4/1989 | Gordon | 473/417 |
| 5,556,091 | 9/1996 | Lin | 473/417 |
| 5,580,047 | 12/1996 | Shih | 473/417 |
| 5,590,876 | 1/1997 | Sejnowski | 473/417 |

*Primary Examiner*—Sam Rimell

*Attorney, Agent, or Firm*—Jacobson, Price, Holman & Stern, PLLC

[57] ABSTRACT

A "baseball hitting exerciser" serving as both a hitting exerciser and a home base plate, including a flexible post, a connecting tube, a fixing tube, an anti-dust cover and a bottom cover. On the bottom end of the fixing tube is a neck connected to a push block; the push block serves to push the anti-dust plate that is compressed by the springs inside the fixing hole, so the push block may be turned and accommodated inside the wing plate troughs in the fixing hole; then, the fixing tube is fixed inside the fixing hole. If the connecting tube is turned again, the bias force of the springs pushing on the anti-dust cover will push the push block away from the fixing hole; so the base plate is restored to the shape of a normal base plate; so the base runner can safely use the base.

1 Claim, 5 Drawing Sheets

BASEBALL HITTING EXERCISER

BACKGROUND OF THE INVENTION

The subject invention relates to a type of "baseball hitting exerciser" that may be used for practicing hitting exercises as well as a base plate.

Baseball has been a very popular sport in Taiwan. Ever since the Hong-Yeh Junior Baseball Team to the present two major baseball leagues, baseball has been widely welcomed by the public; therefore, many baseball superstars have later become international stars; but in routine practice, it is considered uneconomical for a pitcher to pitch each and every ball to the hitter; therefore, the baseball hitting exerciser has come into being.

Conventional baseball hitting exercisers come in all shapes with the employment of different principles, but no such exerciser can be used simultaneously as a running base. In normal practicing routine, after the ball is hit, the hitter has to run the base, and sometimes he has to race with the ball and try to reach the base by sliding; in this case, a normal baseball hitting exerciser becomes a major killer to the safety of the base runner; therefore, the conventional baseball hitting exercisers need to be improved.

SUMMARY OF THE INVENTION

The primary purpose of the subject invention is to provide a type of baseball hitting exerciser that serves the purposes of hitting exercise and a home base to which the runner can slide without worry of personal injury. After the hitter hits the ball, he can rapidly remove the fixing tube from the base plate (or the job may be removed by others), so the subject invention is restored to the shape of a home base; in this case, the runners on other bases can slide to the base; and since there is no obstacle on the base plate that would cause safety concerns, the runner can feel free to slide to the base.

BRIEF DESCRIPTION OF NUMERALS

| | |
|---|---|
| (A) support rack | (B) base plate |
| (A1) screw bolt | |
| (1) flexible post | (11) ball seat |
| (2) connecting tube | (21) matching hole |
| (3) fixing tube | (31) neck |
| (32) push block | (4) home base plate |
| (41) fixing hole | (411) slide channel |
| (412) wing plate trough | (5) anti-dust cover |
| (51) wing plate | (6) bottom cover |
| (61) spring | (62) screw hole |
| (63) screw | (64) sand outlet |

DETAILED DESCRIPTION OF PREFERRED EMBODIMENT

Figure 1:
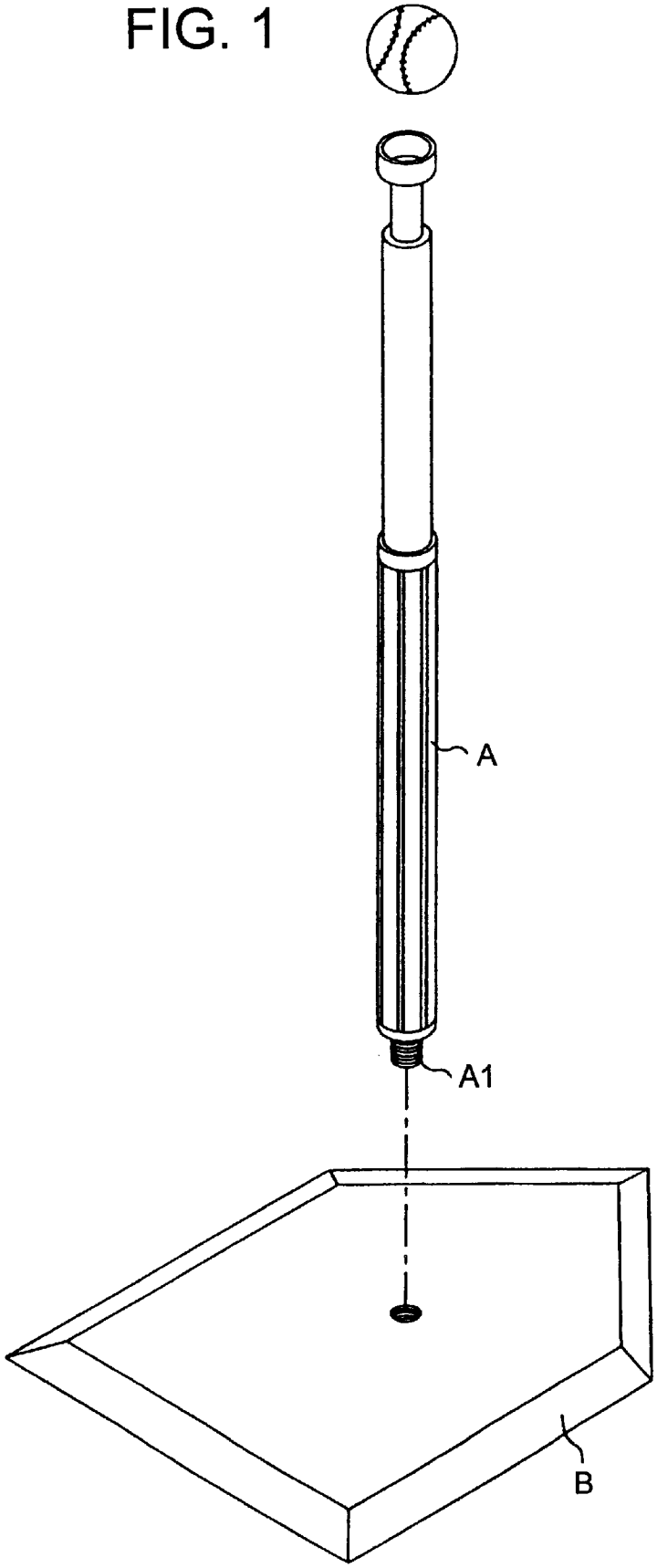
FIG. 1 is a perspective view of a prior art.
Figure 2:
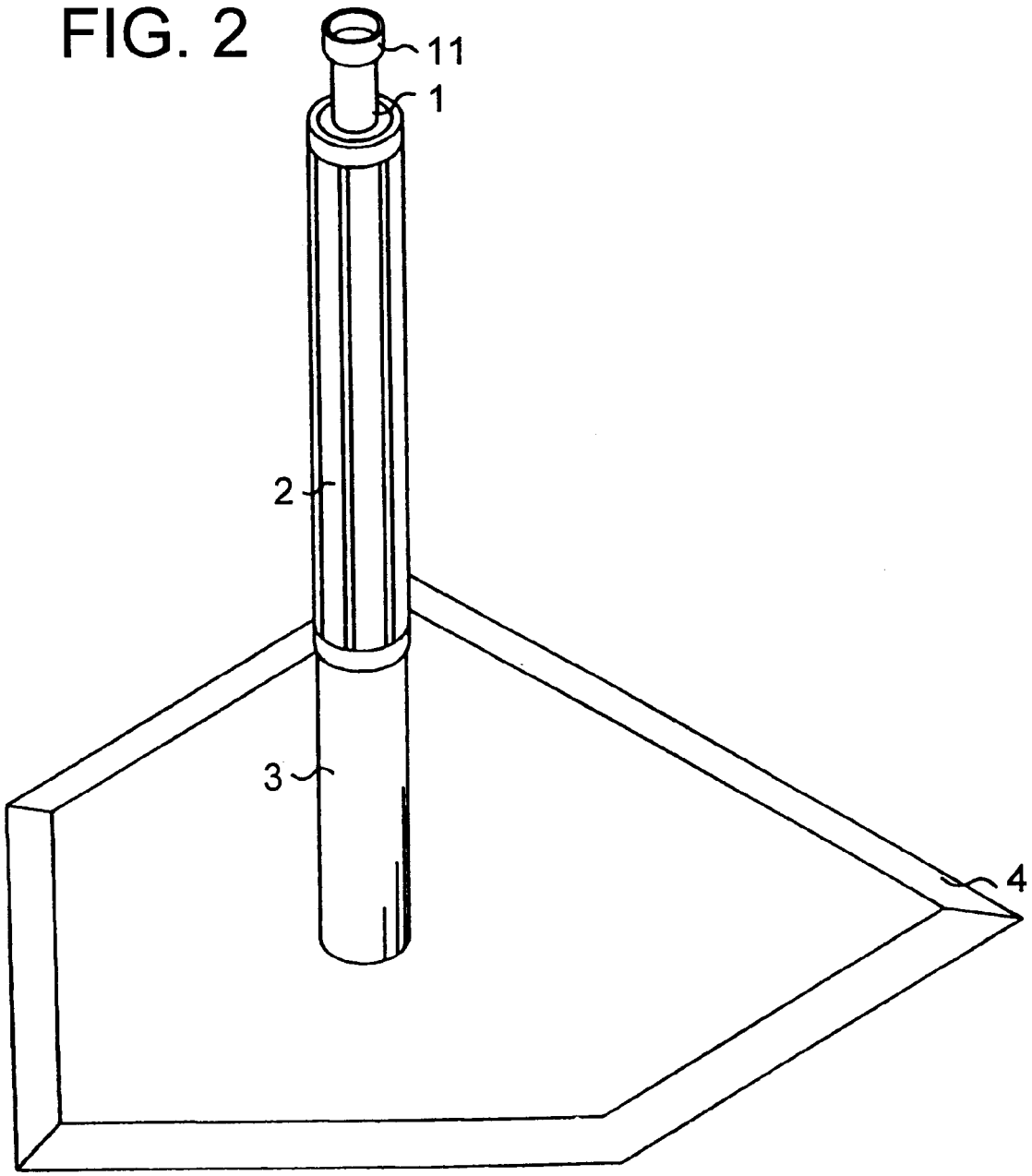
FIG. 2 is a perspective view of the subject invention.
Figure 3:
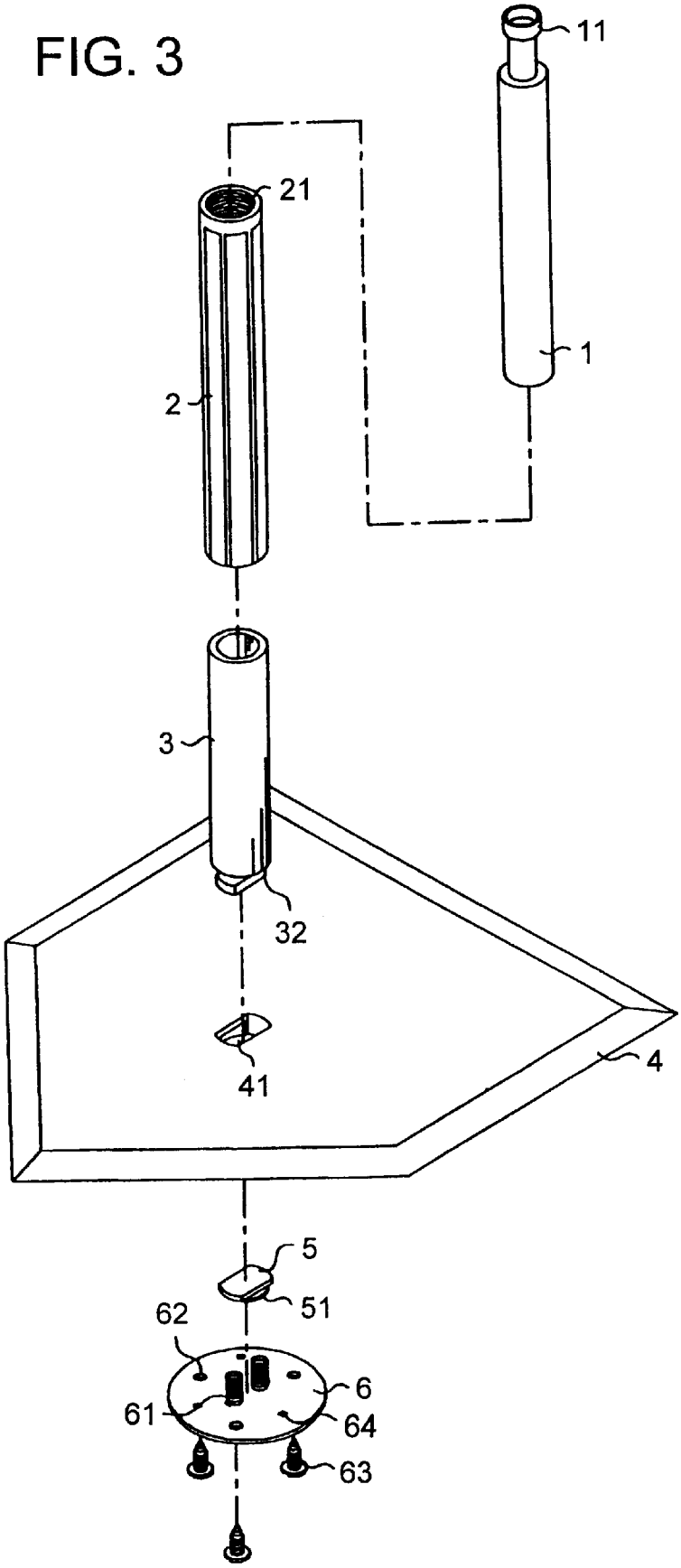
FIG. 3 is an exploded view of the subject invention.
Figure 4:
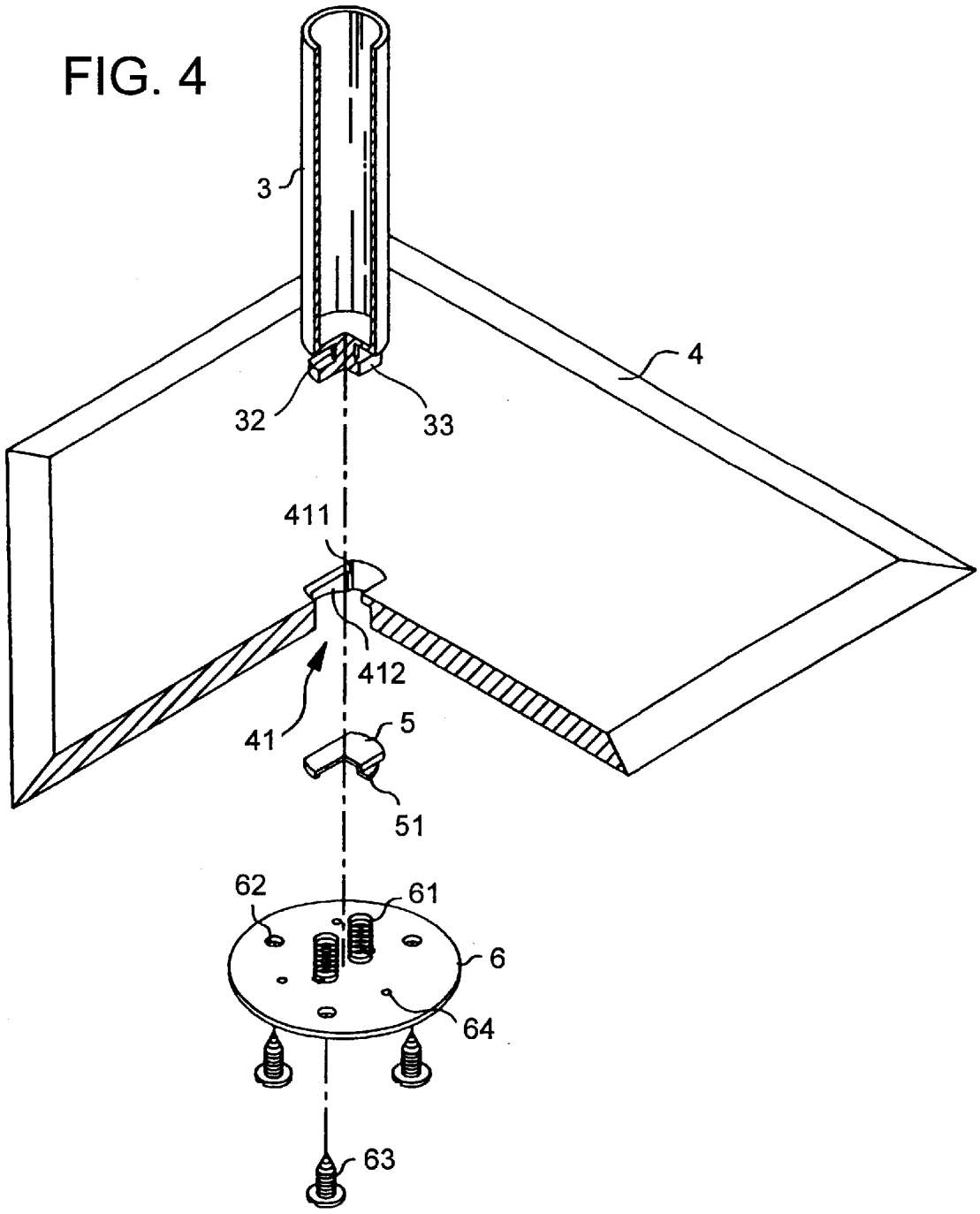
FIG. 4 is a sectional view of a part of the subject invention.
Figure 5:
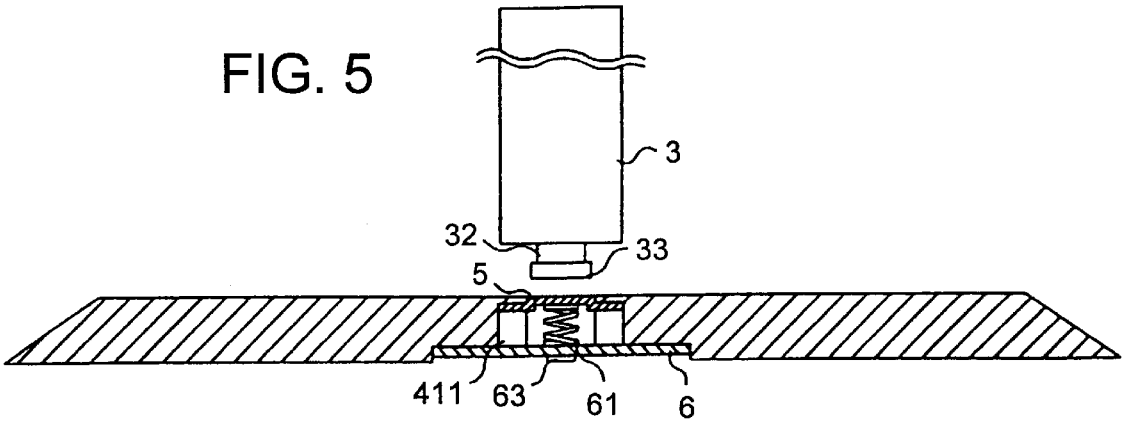
FIG. 5 is an illustration of the subject invention in action.
Figure 6:
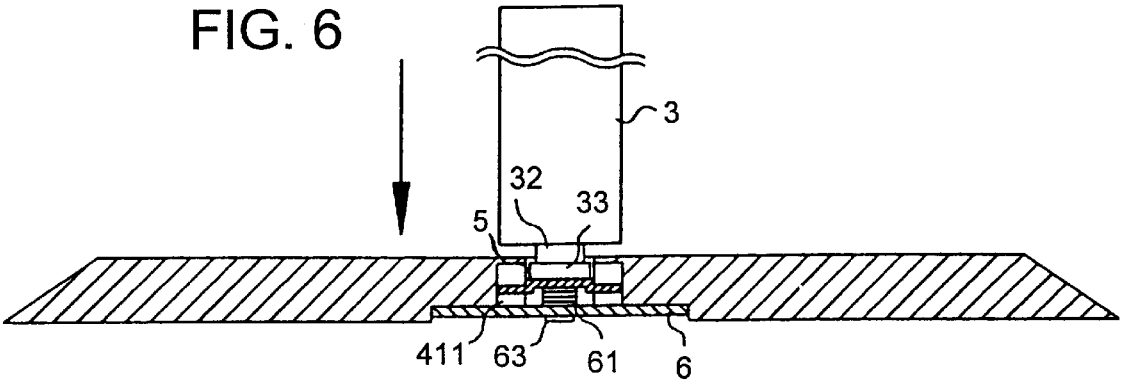
FIG. 6 is an illustration of the subject invention in action.
Figure 7:
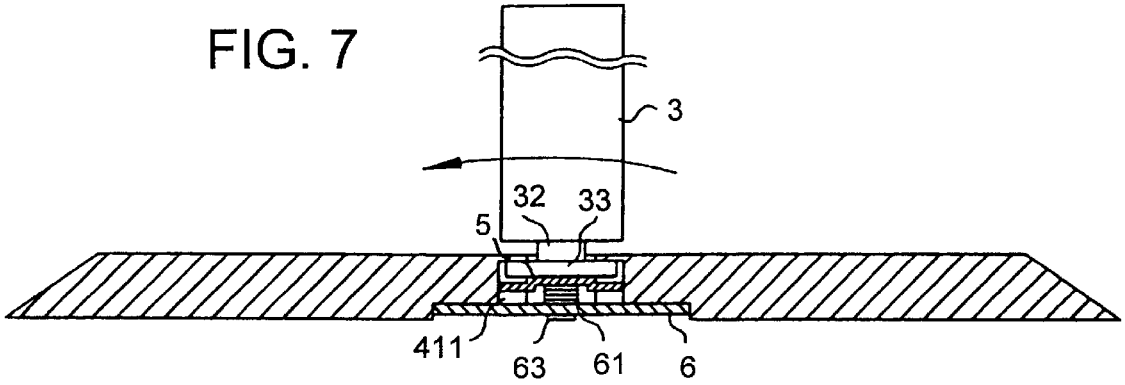
FIG. 7 is an illustration of the subject invention in action.

As illustrated in FIG. 1: In a prior art of baseball hitting exerciser, the support rack (A) is tightened onto the base plate (B) with a screw bolt (A1); so, when the a base runner is running to the base, there is the danger of his bumping into the support rack (A).

As illustrated in other figures: The subject invention is composed of a flexible post (1), a connecting tube (2), a fixing tube (3), a home base plate (4), an anti-dust plate (5) and a bottom cover (6).

On top of the flexible post (1) is a ball seat (11) to place the exercise ball; while the bottom of the flexible post is tightly matched with the matching hole (21) on top of the connecting tube (2).

The design of the flexible post is to prevent damage to the bat or the hitting exerciser in case the bat has missed the ball.

The top of the fixing tube (3) may be inserted inside the bottom end of the connecting tube (2), so that the connecting tube (2) and the fixing tube (3) can be joined. Below the neck (32) at the bottom of the fixing tube (3) is a push block (33); to join the fixing tube (3) with the base plate (4), the push block (33) is used to squeeze the anti-dust plate (5), so the anti-dust plate (5) moves down and the front and rear ends of the push block (33) can smoothly be turned into the wing-plate trough (412) in the fixing hole, (41), so the push block (33) on the fixing tube (3) can be fixed inside the fixing hole (41) by means of the stretching force from the spring (61) on the bottom cover (6).

Since the front and rear ends of the anti-dust plate (5) are slightly protruding out of the wing plate (51), when it is placed in the fixing hole (41), the front and rear ends of the anti-dust plate (5) can only slide up and down, in the slide channel (411) in the fixing hole (41), but could not rotate in it; so when the fixing tube (3) is rotated and pulled out of the base plate (4), the anti-dust plate (5) can be quickly cover the fixing hole (41), so that dust, sand and other stains will not enter the fixing hole (41).

On the bottom cover (6) corresponding to the anti-dust cover (5) are springs (61), to provide the stretching force required for the anti-dust cover (5) to push against the push-block (33), and the force required for the anti-dust cover (5) to tightly seal the fixing hole (41) when the top block (33) disengages from the wing-plate trough (412); meanwhile, on the bottom cover (6) are several sand outlets (64) to release the sand brought into the fixing hole (41) from the top block (33).

As described above, after the hitter hit the ball from the ball seat (11) and before he tries to run to the base, he may quickly rotate the fixing tube (3), then the spring (61) will push on the anti-dust plate (5) and push the push block (32) out of the fixing hole (41), so that there is no obstacle on the base plate (4) to obstruct the runner's returning to the home base.

Summing up, it is obvious that the subject invention is indeed an unprecedented creation not yet disclosed in any publications, with its applicability and originality that will fully satisfy the qualifications for a patent right, hence this application is filed in accordance with the Patent Law to protect the subject inventor's rights and interests. Your favorable consideration should be appreciated.

I claim:

1. A baseball hitting exercise device comprising:

a flexible post having a ball seat;

a first tube secured to said flexible post;

a second tube secured to said first tube and having a push block;

a home base plate having a hole leading to a slide channel;

an anti-dust cover slidably mounted in said slide channel;

a bottom cover mounted on a bottom surface of said home base plate and enclosing said slide channel;

whereby the push block is located in said slide channel and opposite ends of the push block are positioned inside the slide channel and the flexible post can be used as a baseball hitting exerciser and whenever necessary, the second tube can be removed quickly from the hole by turning the second tube and withdrawing the second tube from the hole, so that the home base plate can be restored to use as only a home base plate.

* * * * *